US005098323A

United States Patent [19]

Poldervaart et al.

[11] Patent Number: 5,098,323

[45] Date of Patent: Mar. 24, 1992

[54] DEVICE FOR POSITIONING OF A BUOY BODY

[75] Inventors: Leendert Poldervaart; Willem C. De Boom, both of Marly, Switzerland

[73] Assignee: Single Buoy Moorings, Inc., Marly, Switzerland

[21] Appl. No.: 622,164

[22] Filed: Dec. 3, 1990

Related U.S. Application Data

[63] Continuation of Ser. No. 390,811, Aug. 8, 1989, abandoned.

[30] Foreign Application Priority Data

Jul. 14, 1989 [EP] European Pat. Off. ..... 89201874.8

[51] Int. Cl.[5] ..... B63B 22/02

[52] U.S. Cl. ..... 441/4; 441/28

[58] Field of Search ..... 441/3-5, 441/28-29; 114/230

[56] References Cited

U.S. PATENT DOCUMENTS

| | | | |
|---|---|---|---|
| 3,077,614 | 2/1963 | Lloyd | 441/3 |
| 3,103,020 | 9/1963 | Bolton | 441/3 |
| 3,390,408 | 7/1968 | Lockwood, Jr. et al. | 441/28 |
| 3,604,030 | 9/1971 | Claflin | 441/3 |
| 3,782,458 | 1/1974 | Slack | 141/387 |
| 4,069,529 | 1/1978 | van Heijst | 441/5 |
| 4,310,937 | 1/1982 | Karl et al. | 441/5 |
| 4,326,312 | 4/1982 | Tang | 441/5 |
| 4,527,501 | 7/1985 | Poldervaart | 114/230 |
| 4,617,000 | 10/1986 | Girardot et al. | 441/3 |

FOREIGN PATENT DOCUMENTS

| | | |
|---|---|---|
| 2290345 | 6/1976 | France . |
| 7312778 | 3/1975 | Netherlands . |
| 2015455 | 9/1979 | United Kingdom . |

*Primary Examiner*—Sherman Basinger
*Attorney, Agent, or Firm*—Young & Thompson

[57] ABSTRACT

Device for positioning a buoy body, comprising a ballast weight which in use is positioned under the buoy body and is provided with anchors, and a coupling connecting the ballast weight to the buoy body. The greatest horizontal cross sectional dimension of the buoy body is substantially less than the height of the buoy body. The buoy is spaced a substantial distance from the ballast weight. An elongated tubular member is secured to and extends upwardly from the ballast weight, the buoy body surrounding only the upper end of this tubular member. Swivel bearings interconnect the tubular member and the buoy body for relative rotation about an upright axis.

7 Claims, 1 Drawing Sheet

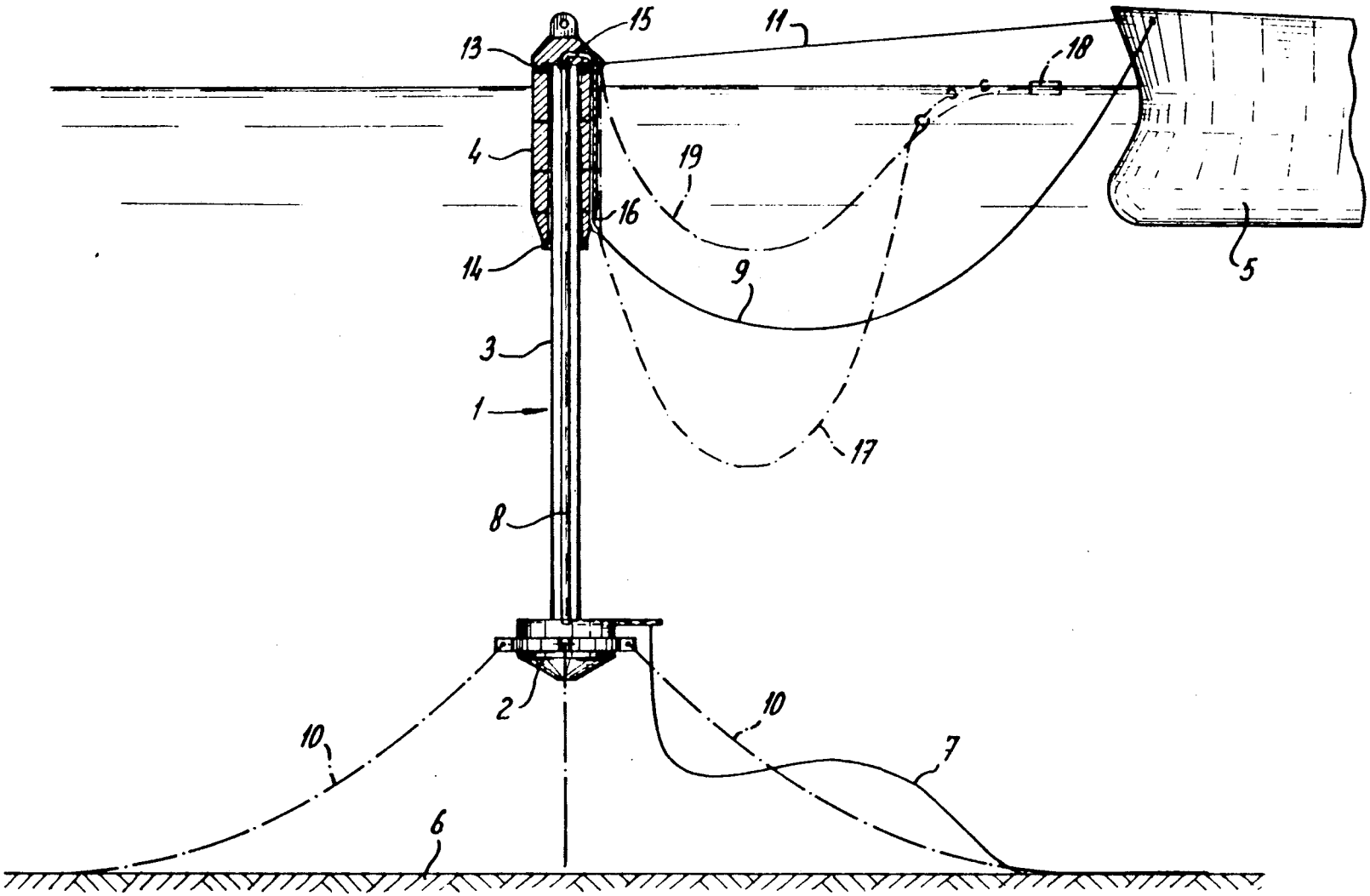
5
18
11
15
13
4
14
3
1
8
2
6
10
10
7
9
19
16
17

DEVICE FOR POSITIONING OF A BUOY BODY

This application is a continuation of application Ser. No. 07/390,811, filed 8/8/89 and now abandoned.

The invention relates to a device for positioning of a buoy body, comprising a ballast weight in use positioned under said buoy body and being provided with anchoring means, and coupling means connecting said ballast weight to said buoy body.

Such a device is known from GB-A-2,015,455 of applicant, wherein a buoy body is described having a substantially flat shape.

This means that its mean horizontal cross sectional dimension is larger than the height of the buoy. All other buoys used in the prior art for this kind of devices are embodied in substantially the same way. However, during use it became clear that this buoy has the drawback that the large surface area near the water line of the buoy body is a disadvantageous attacking point for waves and ice. Forces of waves are sent through the coupling means to the ballast weight and from the ballast weight via the anchor lines to the sea bed. Because of the relatively large influence of waves on the buoy body the anchor lines are subjected to considerable peak loadings during high sea. Of course it is important for the buoy body to have sufficient floating capacity.

The invention aims to obviate these drawbacks. According to the invention this is realized in that the mean horizontal cross sectional dimension of the buoy is smaller than the height of the buoy.

By having the buoy long and slender the surface area subjected to the influence of the forces occurring at the water line is considerably decreased, whilst the buoyancy is maintained. This means that high waves do not give such an extreme peak force on the anchor lines as with the prior art buoy body. Furthermore the decreased surface area gives a smaller surface on which floes can hit.

It is possible to provide at least one articulated connection to one of said buoy body and said ballast weight. By having at least one articulation point bending moments in the coupling means can be reduced. However, this has as a drawback that it is relatively complicated and that the buoy body size has to be increased to compensate for the extra weight of the articulation points.

According to the invention this disadvantage is obviated in that said coupling means are embodied such that a substantially rigid connection between the buoy body and the ballast weight is obtained. The device according to the invention acts as a tumbler such that when a vessel exerts a traction force on the buoy body it will no longer remain in the same horizontal position with regard to the water surface as with the prior art but tilted. Because of this an extra restoring moment in the system is generated by the buoyancy of the device, which is at a distance from either an articulation point or from the weight which acts as an articulation point around the anchor lines, the traction force from the vessel will lift the anchor lines, this increases the weight suspended from the buoy body which consequently will submerge the buoy body and thus decrease the peak forces even further. By not having a pivot connection at the buoy body it is possible to make this buoy body much smaller such that its resistance to the waves will decrease. This also has a beneficial effect if ice is present in waters wherein the device according to the invention has to be used.

According to a preferred embodiment of the invention the coupling means comprise an elongated tubular member. Flow lines from the ballast weight can be routed through the tubular member, such that a much better protection is obtained against exterior influences than with the device according to the prior art in which the flow lines were outside of the link member.

According to a further embodiment of the invention a swivel body is provided at the buoy body. This swivel preferably comprises at least two spaced bearings rotatably mounted relative to said coupling means. Because of this an increased distance between the bearings is possible resulting in a structurally improved embodiment.

According to a further embodiment the buoy body is provided with an end cap at its end remote from the ballast weight and at least one opening for the flow line(s) in the swivel is located below water level. By having the openings for the flow lines below water level they are not exposed to such a heavy environment as in the prior art wherein these openings are above water level and wherein the flow lines are subjected to the motion of the waves and to ice.

The invention will be further elucidated with reference to the drawing wherein the sole figure schematically shows an embodiment according to the invention having a rigid connection between the buoy body and the ballast weight.

In the drawing the device according to the invention is generally indicated with 1 and comprises a ballast weight 2, a riser 3 and buoy body 4. The device 1 is designed to anchor a vessel 5 of which only a part is shown. Flow lines 7,8,9 connect the sea bed 6 with the vessel 5. Ballast weight 2 is connected with anchors and anchor lines 10 to sea bed 6. Vessel 5 is connected to buoy body 4 with mooring line 11. Between riser 3 and buoy body 4 bearings 13,14 are provided such that buoy body 4 acts like a swivel relative to riser 3. The end of flow line 8 is connected to conduit 15 by means (not shown) to enable a rotation of buoy body 4 relative to riser 3. The conduit 15 leaves buoy body 4 at 16 below water level. Riser 3 is fixed to ballast weight 2 and rotatably connected to buoy body 4. This means that if a traction force is exerted on mooring line 11 both buoy body 4 and ballast weight 2 will tilt giving a larger restoring moment compared with devices described in the prior art. Because of the fixed connection between riser 3 and ballast weight 2 it is relatively simple to introduce flow line 7 in riser 3 (flow line 8) where it is protected against exterior influences. By having flow line 9 below sea level as much as possible also this flow line is protected against the influences of waves, ice etc. After vessel 5 has been disconnected from buoy body 4, anchor line 11 and flow line 9 will be in the position indicated with chain lines respectively 19 and 17 because of the presence of floating body 18. Also in this condition these lines are protected against influences acting near sea level.

We claim:

1. Device for positioning a buoy body above a sea floor, comprising a ballast weight which in use is positioning under said buoy body and is spaced above the sea floor and is provided with anchor lines interconnecting the ballast weight and the sea floor, said lines extending from the weight diagonally downward in different directions away from the weight and being the sole means anchoring the weight to the sea floor, and coupling means connecting said ballast weight to said buoy body, the greatest horizontal cross sectional dimension of the buoy body being substantially less than the height of the buoy body, the buoy body being spaced a substantial distance from the ballast weight, said coupling means comprising an elongated tubular member secured to and extending upwardly from the ballast weight, the buoy body surrounding only the upper end of said tubular member, swivel means interconnecting the tubular member and the buoy body for relative rotation about an upright axis, and means preventing relative rotation of said tubular member and the buoy body about any axis other than said upright axis.

2. A device as claimed in claim 1, said swivel means comprising at least two vertically spaced bearings between said buoy body and said tubular member.

3. A device as claimed in claim 1, there being a conduit for liquid that extends from said ballast weight upward within said tubular member to an upper portion of said buoy body and then within said buoy body to a lower portion of said buoy body where said conduit emerges from said buoy body.

4. A device according to claim 1, wherein the buoy body comprises form material.

5. A device according to claim 1, the tubular member being rigid from the ballast weight to a point adjacent the upper end of the buoy body.

6. A device according to claim 1, further comprising means preventing rotation of said tubular member and said ballast weight about any axis relative to each other.

7. A device according to claim 1, further comprising a conduit for liquid that extends from said ballast weight upward within said tubular member to and beyond said buoy body.

* * * * *